US010850815B2

(12) United States Patent
Beckman

(10) Patent No.: US 10,850,815 B2
(45) **Date of Patent: *Dec. 1, 2020**

(54) WATER RESCUE DEVICES USING EXPANDING FLOTATION NETS AND OTHER EXPANDING, BODY-GRIPPING FORMS

(71) Applicant: Christopher V. Beckman, Los Angeles, CA (US)

(72) Inventor: Christopher V. Beckman, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/525,557

(22) Filed: Jul. 29, 2019

(65) Prior Publication Data

US 2019/0375486 A1 Dec. 12, 2019

Related U.S. Application Data

(63) Continuation of application No. 15/847,873, filed on Dec. 19, 2017, now Pat. No. 10,364,004, which is a continuation-in-part of application No. 14/923,422, filed on Oct. 26, 2015, now Pat. No. 9,846,006, which is a continuation-in-part of application No. 14/515,486, filed on Oct. 15, 2014, now Pat. No. 9,170,074, which is a continuation-in-part of application No. 13/656,707, filed on Oct. 20, 2012, now Pat. No. 8,875,433.

(51) Int. Cl.
*B63C 9/08* (2006.01)
*B63C 9/18* (2006.01)

(52) U.S. Cl.
CPC . *B63C 9/08* (2013.01); *B63C 9/18* (2013.01)

(58) Field of Classification Search
CPC ..... B63C 9/00; B25G 1/04; F41A 9/04; F41A 9/70; F41A 9/83; F41A 33/04; F41H 5/007; F41H 5/08
See application file for complete search history.

(56) References Cited

U.S. PATENT DOCUMENTS 5,954,556 A * 9/1999 Powers ..... B63C 9/155 441/108
10,364,004 B2 * 7/2019 Beckman ..... F42B 5/035

* cited by examiner

*Primary Examiner* — J. Woodrow Eldred

(57) ABSTRACT

New water rescue devices and methods of use are provided. In some embodiments, a rescue device comprises an inflatable net with a handle, and a switch for causing the inflation of the inflatable net. In some methods, a user positions the inflatable net underneath at least part of a person or other object prior to inflation, and the inflating net rises due to increased buoyancy, while water passes through and below the net. The rising net lifts the person or object above the surface of a body of water, rescuing the person or object. In some embodiments, the invention is incorporated in a rescue buoy or rescue can. In some embodiments, an inflatable body other than a net also, or alternatively, is provided. For example, an expanding flotation ring or other flotation device is provided, which envelopes and holds the person or object when inflated.

20 Claims, 8 Drawing Sheets

WATER RESCUE DEVICES USING EXPANDING FLOTATION NETS AND OTHER EXPANDING, BODY-GRIPPING FORMS

RELATED APPLICATION DATA

This application is a continuation-in-part of co-pending U.S. patent application Ser. No. 15/847,873, filed Dec. 19, 2017, (now U.S. Pat. No. 10,364,004), which is a continuation-in-part of U.S. patent application Ser. No. 14/923,422, filed Oct. 26, 2015 (now U.S. Pat. No. 9,846,006), which is a continuation-in-part of U.S. patent application Ser. No. 14/515,486, filed Oct. 15, 2014 (now U.S. Pat. No. 9,170,074), which is a continuation-in-part of U.S. patent application Ser. No. 13/656,707, filed Oct. 20, 2012 (now U.S. Pat. No. 8,875,433), the entire contents of each of which applications are hereby incorporated herein by reference in their entirety as if fully set forth in the present application.

FIELD OF THE INVENTION

The present invention relates to the field of rescue devices, and, more particularly, in some embodiments, expandable nets and other expandable interceptors, rescue buoys, life rings and life belts.

BACKGROUND

The inventive subject matter disclosed in this application, including applications incorporated by reference herein, relates to several technical fields, including a wide variety of devices used by the military and other first-responders to emergencies. For ease of understanding, and without prejudice to or waiver of any matter set forth or incorporated in this application, this Background will relate only to the matter being claimed in the present application.

The present application relates to rescue tools and, in particular, emergency flotation devices. Flotation devices have been used for sea rescue for many years. In the current art, some flotation devices are built into garments, as in the "life jacket." Some flotation devices are designed to be thrown to a person in distress, from another person on a boat or solid ground (e.g., "life preservers," "life savers" or "life rings"). Yet other devices are designed to be carried with a first responder into the water, to aid in flotation of the first responder using the device, or a person being rescued (e.g., "rescue buoys").

It should be understood that the disclosures in this application related to the background of the invention in, but not limited to, this section (titled "Background") are to aid readers in comprehending the invention, and are not necessarily prior art or other publicly known aspects affecting the application; instead the disclosures in this application related to the background of the invention may comprise details of the inventor's own discoveries, work and work results, including aspects of the present invention. Nothing in the disclosures related to the background of the invention is or should be construed as an admission related to prior art or the work of others prior to the conception or reduction to practice of the present invention.

SUMMARY OF THE INVENTIVE SUBJECT MATTER

The inventive subject matter set forth in the present application relates to new water rescue devices, systems and methods of use. In some embodiments of the invention, a rescue device comprises an inflatable or otherwise expandable net with a handle, and a switch for causing the inflation of the inflatable net. In some methods in accordance with aspects of the present invention, a user directs or positions the inflatable net underneath at least part of a person or other object prior to inflation, and the inflating net rises due to increased buoyancy, while water passes through and below the net. The rising net lifts the person or object at least partially above the surface of a body of water, rescuing the person or object. In some embodiments, the invention is incorporated in a rescue buoy or rescue can. In some embodiments, an inflatable body other than a net also, or alternatively, is provided. For example, in some embodiments, an expanding flotation ring or other flotation device is provided, which envelopes and holds the person or object when inflated.

In some aspects of the invention, a rescue device comprises a dense, positionable head, an extendable boom and a handle with an expansion and/or inflation trigger, wherein the positionable head comprises folded or compacted net, expandable and/or inflatable by the expansion and/or inflation trigger within or about a handlegrip. In related methods of use, the handlegrip may be held by a user who positions and extends the boom as necessary to place the positionable head underneath a person or other animal or object in a body of water. The user may then activate the trigger, causing the head to expand and/or inflate, becoming a buoyant net, which then rises within the more-dense water, and captures person, animal or object, raising them to the surface of the body of water. In this way, the risk of injury to both the user and object raised is minimized, while the odds of successful rescue are increased, when compared to conventional methods of water rescue.

It should be understood that, for convenience and readability, this application may set forth particular pronouns and other linguistic qualifiers of various specific gender and number, but, where this occurs, all other logically possible gender and number alternatives should also be read in as both conjunctive and alternative statements, as if equally, separately set forth therein.

DETAILED DESCRIPTION OF THE INVENTION

Figure 1:
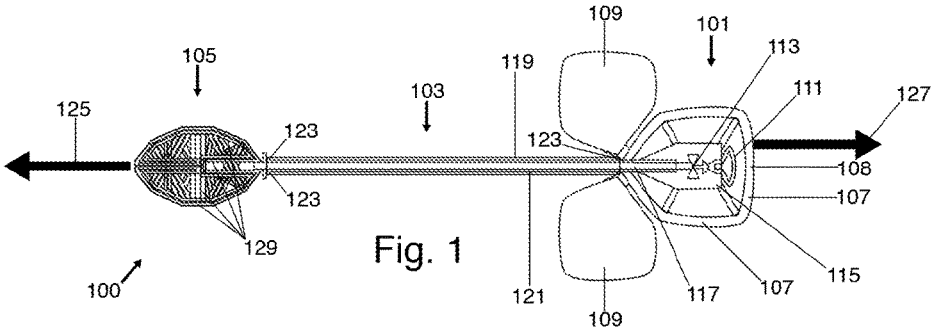
FIG. 1 is a top view of an exemplary rescue device, incorporating an expandable net flotation device, in accordance with some embodiments of the present invention.
Figure 3:
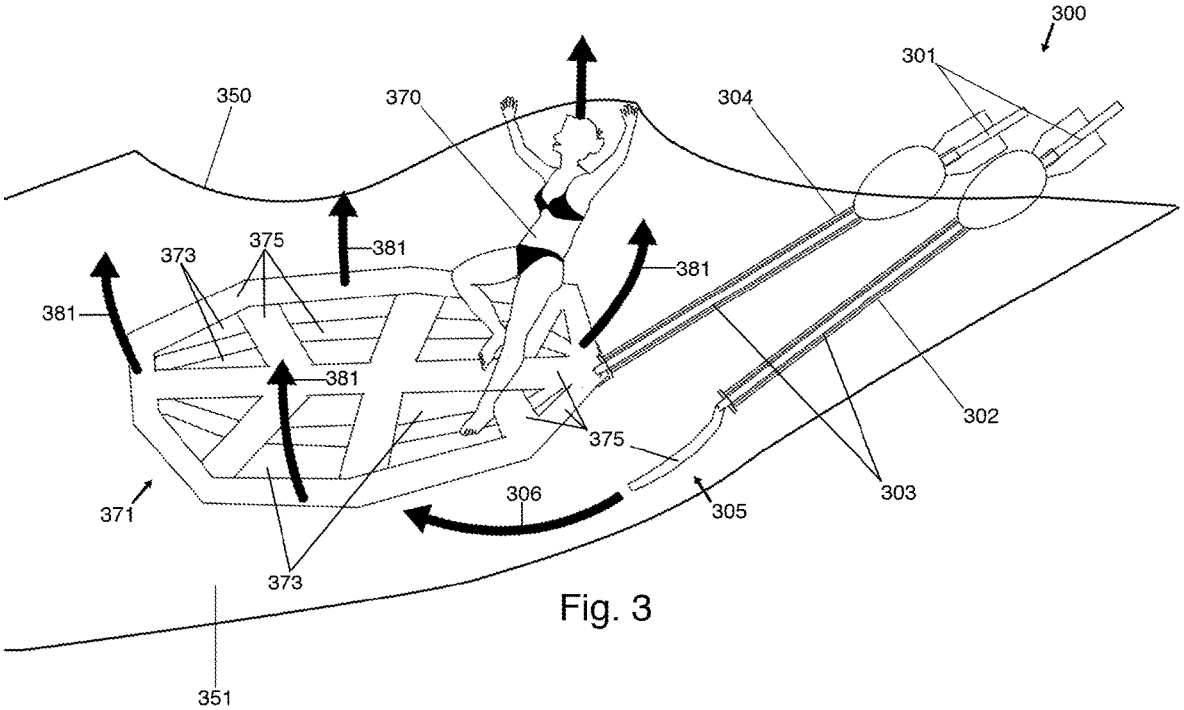
FIG. 3 is a side view of an exemplary rescue device, similar in nature to the rescue tools set forth above, in reference to FIGS. 1 and 2, in multiple positions, in action rescuing a person in distress in a body of water, in accordance with some embodiments of the present invention.

FIG. 1 is a top view of an example rescue device, in the form of an expandable net flotation device 100, in accordance with some embodiments of the present invention. Generally speaking, in some embodiments, expandable net flotation device 100 comprises three major sections: (1) a handle and/or grip section 101; (2) a telescoping boom section 103; and (3) an expandable and/or inflatable compressed head section 105. As will be explained in greater detail below, expandable and/or inflatable compressed head section 105 comprises an expandable and/or inflatable flotation device in the format of a compressed, folded, uninflated and/or condensed net, which can be expanded and inflated by a user rescuing a person or item from a body of water. An example of such an expanded and inflated flotation device is shown in FIG. 3, as discussed below. In the present figure, some elements of the device, in its pre-operative state, will be discussed first.

Handle and/or grip section 101 is attached at one end of telescoping boom section 103, and allows the user to manipulate and position both telescoping boom section 103 and the expandable head section 105, which is attached to the other end of telescoping boom section 103. To ease that handling and positioning, and access for a user, a variety of handgrips, such as the examples shown as 107, may be provided on or about handle and/or grip section 101. In some embodiments, handle and/or grip section 101 is, itself, a flotation device, providing enough buoyancy in fresh or sea water to prevent the entire expandable net flotation device 100 from sinking when placed in the middle of a large body of water, such as a lake or ocean. In other embodiments, additional flotation devices, such as exemplary pivoting flotation devices ("floats") 109, may also, or alternatively, be provided. Exemplary pivoting (or pivot-enabling, rounded) floats 109 may be provided with bilateral symmetry, on or about a balanced fulcrum of expandable net flotation device 100, with approximately equal weight of expandable net flotation device 100 to the left and to the right of their position along the length of boom section 103 and expandable net flotation device 100. Alternatively, somewhat more weight may be to the left of the float's 109 position, encouraging head section 105 to descend somewhat, underneath the top surface of a body of water in which it is placed, and encouraging a proper deployment position (such deployment positions being discussed in greater detail below, in reference to FIG. 3).

Within handle and/or grip section 101, a trigger 111 may be provided. Trigger 111 may be of any suitable form for user controls, switches and releases known in the art for triggering the inflation or expansion of flotation devices or actuators. In the example trigger 111, which is not limiting, a grippable bar is provided within the reach of a user's fingers, allowing a user who is already holding grip 108 to actuate trigger 111 without having to let go of grip 108. This exemplary configuration, along with other aspects of the invention, also aids in the one-handed operation of expandable net flotation device 100 by a user. To perform its expansion of head section 105, trigger 111 may be connected with a valve 113, variably sealing and releasing gas from a compressed gas tank 115, which may, as shown, reside within handle and/or grip section 101, in some embodiments. When trigger 111 is actuated by a user, gas is then released from tank 115 through valve 113, and into head section 105, in some embodiments, through a connection tube or other hollow body (e.g., boxes or other shapes) 117 (connected with tank 115 and head section 105), which may be held in the interior of boom section 103, as pictured. In some embodiments, connection tube 117 may be folded or linearly stretchable, allowing it to remain so connected when telescoping boom section 103 is extended, as discussed further below. In other embodiments, tank 115 may be mounted closer to head section 105 (e.g., on outer tube or hollow body 119), allowing for a shorter length connection tube (or the omission altogether of a connection tube, in favor of a direct connection between tank 115 and head section 105, as also discussed for some embodiments, below).

As mentioned above, telescoping boom section 103 allows a user to vary the length of expandable net flotation device 100, reaching deeper into a body of water, when extended, or to more shallow depths, when retracted, and, generally, allows a user to optimize the positioning of head section 105 below a person or object to be lifted to the surface of the body of water (as discussed in this application). To allow for that user-variable expansion and/or retraction, boom section 103 may comprise two sliding and telescoping tube or other hollow body sections: Outer tube section 119, and inner tube section 121. Both outer tube section 119 and inner tube section 121 preferably comprise a rigid, rugged, lightweight, and strong material, such as, but not limited to, plastic, aluminum, fiberglass and/or carbon fiber. Inner tube section 121 may be affixed to or part of handle and/or grip section 101, while outer tube section 119 may be affixed to or part of head section 105. In any event, tubes 119 and 121 are preferably slidlingly engaged with one another, yet connected (e.g., with positive stops 123 and or connection tube 117) such that, if fully extended, inner tube 121 does not slide completely out of outer tube 119, but lengthens the overall profile of device 100, as shown by expansion arrows 125 and 127. The precise configuration discussed herein is exemplary, not exhaustive, of the many possible formats for structural pieces joining and allowing the manipulation of compressed flotation devices, in accordance with the present invention. As discussed further below, and as will be understood by those of ordinary skill in the art, other formats, such as a boom with single rigid piece, rather than two or more telescoping or otherwise expanding pieces, may also, or alternatively, be used in some embodiments. As also discussed below, other shapes and lengths (e.g., U-shaped or box-shaped), and the omission altogether, of such structural pieces in favor of more direct connections between other aspects of the invention, may be provided in some embodiments.

Head section 105 comprises a folded and/or compressed, expandable/inflatable net 106 that, when triggered to expand and/or inflate, as mentioned above, has a positive buoyancy, leading it to rise and capture any object of a size greater than the holes of its matrix, as illustrated below, in FIG. 3. However, in the folded and compressed state shown, net 106 has a negative (or, in some embodiments, neutral or less) buoyancy, allowing it to be placed below a person or object to be recovered from a body of water. Expandable/inflatable net 106 comprises an array of interconnected, cross-latticed hollow tubes or other bodies (e.g. creating boxes or other 3D shapes when inflated or expanded) 129 that, when inflated or otherwise expanded, create an expanded net or lattice of expanded, floating tubes or other bodies and open holes between them (smaller than any object sought to be captured in the net), which rise in a more dense or upward-moving fluid, until it collides with and captures a person or object, pushing it in the same direction (e.g., toward the surface of a body of water, as shown in FIG. 3, below).

As mentioned above, in some embodiments, boom section 103 may be of a fixed length (not telescoping or extendable), or may even be omitted altogether, in favor of a direct connection between tank 115 and valve 113. In such embodiments, handle and/or grip section 101 may be provided with a closer or more direct connection to compressed head section 105. In such embodiments, handle and/or grip section may be less buoyant than in embodiments discussed above, to allow the user to push or swim with expandable net flotation device 100 underwater more easily, directly positioning it below the person or object to be rescued. In some embodiments, expandable net flotation device 100 may even have a neutral or negative buoyancy in the body of water in which it is to be used, allowing a user to drop or "throw" expandable net flotation device 100 underneath the person or object to be rescued. In such embodiments, trigger 111 may operate with a time release or pressure-actuated release, such that expandable net flotation device 100 first has an opportunity to descend underneath the person or object, before being inflated, after it is so dropped and/or thrown.

Although the example of a triggered valve and compressed gas inflation and expansion of a floating net is provided in the present application, it should be understood that any known or recited method for expanding rescue devices may also, or alternatively, be employed in accordance with aspects of the present invention to recover or intercept persons or objects. For example, in some embodiments, exploding charges may be used, which impact and expand a net or net matrix before it impacts the person or object to be intercepted. In other embodiments, force loading (e.g. springs and elastics) may be present within the expandable net, which, when triggered or released, cause the expansion of an expandable net. In still other embodiments, air or other fluid movement on or about the net, when released, may cause both the expansion and interception of the net, in addition to, or as an alternative to, the expansion of a net by compressed gas. Although the example of a physically connected, pressure-actuated valve and trigger are provided, it should be readily understood that any form of actuator or trigger (including wired and wireless actuators or triggers) may also, or alternatively, be used to carry out aspects of the invention. In the event of actuation by wired or wireless communications, a control system, such as the control system set forth below, in reference to FIG. 12, may be included within device 100, and connected to, and able to carry out communications with, an electronic, gesture or voice-actuated trigger and/or valve or other inflation and expansion actuator. The specific examples provided herein are not limiting, but merely exemplary, of the many aspects which may be used to implement aspects of the present invention, as will be apparent to those of ordinary skill in the art.

Figure 2:
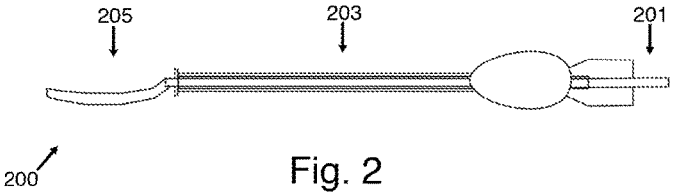
FIG. 2 is a side view of an example rescue device, similar in nature to that set forth above, in reference to FIG. 1.

FIG. 2 is a top view of an example rescue device 200, similar in nature to that set forth above, in reference to FIG. 1. The same major types of sections, a handle and/or grip section 201; (2) a telescoping boom section 203; and (3) an expandable and/or inflatable compressed head section 205, are shown from the side perspective, to aid the reader in comprehending FIG. 3, below, illustrating device 100 or 200, which is shown in the side perspective in that figure. In addition, a generally concave upward-facing configuration of head section 205 can be seen. This configuration aids in capturing and holding a person or object to be recovered by rescue device 200, even without expansion or inflation, and reflects a similar configuration which may be provided in the expanded and/or inflated configuration (a shown below, in FIG. 3).

FIG. 3 is a side view of an example rescue device 300, similar in nature to the rescue devices set forth above, in reference to FIGS. 1 and 2, in multiple positions in action rescuing a person in distress in a body of water, in accordance with aspects of the present invention. First, exemplary pre-deployment position 302 is shown, in which a user has positioned head section 305 under the surface 350 of a body of water 351. However, a user has not yet expanded or inflated head section 305 but, rather, has merely positioned the unexpanded head section 305 below, partially under and to the side of a person 370 to be recovered from the body of water (namely, on the same side of the person as the handle and/or grip section 301). Once triggered, however, and head section 305 expands and inflates, as shown by expansion arrow 306 and exemplary position 304, becoming an upward-traveling buoyant net 371, its larger size automatically positions the resulting expanded net 371 more centrally below the person 370. The resulting floating net 371 has a generally expanded, unfolded and/or inflated shape and size, in comparison to compressed head section 305, but maintains some of its characteristics, including its attachment to boom section 303 and handle section 301, allowing a user to continue to manipulate the position of net 371, and a person or other object held within it. It should also be noted that the holes, such as the examples provided as 373, between the inflated tubes or other bodies, such as the examples shown as 375, of the net 371, are of sufficient size to allow the rapid flow of water (or other fluid) downward as net 371 rises, but is not greater in size that the object or person 370 to be captured. As a result, once net 371 has floated upward (as shown by upward movement/force arrows 381), it captures person 370 and raising her to the surface 350 of the body of water 351, and the user may then tow the person 370 to shore, and perform other emergency or rescue procedures.

Figure 4:
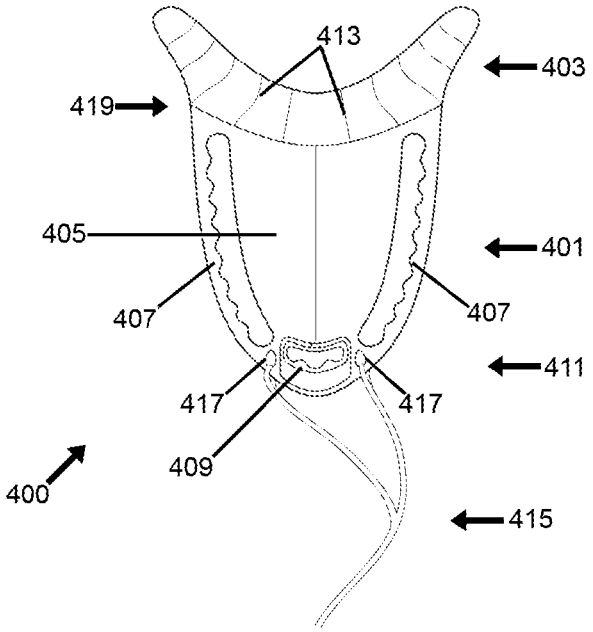
FIG. 4 is a top view of another example rescue device, in accordance with some embodiments of the present invention.

FIG. 4 is a top view of another example rescue device 400, in accordance with some embodiments of the present invention. Rather than comprising a telescoping boom (such as telescoping boom section 103, discussed above) as an intermediary between a handle section and a flotation device, in some embodiments (as pictured), rescue device 400 includes a handle and/or grip section 401 which is attached directly (or, more directly, in some embodiments) to a different form of expandable section 403.

In some embodiments, handle and/or grip section 401 includes a main body 405, which serves as a supporting structure or frame for hand grips 407, hand control 409, expandable section 403, and other structural parts to which it is attached, which will be discussed in greater detail below. In some embodiments, main body 405 comprises, or is at least partially in the form of, or similar in form to, a buoyant rescue buoy.

As with other rescue devices set forth in the present application, the expandable section 403 of rescue device 400 comprises an expandable flotation device, which can be expanded by a user rescuing a person or object from a body of water. In some embodiments, such an expanded form can be a floating net. However, in other embodiments, such an expanded form can be a less complex structure that also floats in water, such as a rod, bar, or, as set forth immediately below, in FIG. 6, a ring or other structure that envelops a person or object upon expansion. In some embodiments, such expandable section 400 may be expanded by inflation with a gas, such as compressed air or carbon dioxide. However, in the present figure, some elements of rescue device, in its unexpanded state, will be discussed prior to exploring such expanded forms in more detail.

Hand grips 407 are provided on or about an outer edge of main body 405, allowing for easy access by any nearby person and, especially, a user-facing end 411 of rescue device 400. In some embodiments, a user, such as a first responder (e.g., a lifeguard) may rescue to a distressed person or object in a body of water by running into the body of water towards the distressed person or object, while carrying rescue device 400 by one or both of hand grips 407, diving in the water, swimming with rescue device 400, and approaching the distressed person or object's immediate vicinity. In some embodiments, the user may then reach out and grab one of hand grips 407, to aid in floating him or herself. In some embodiments, the user causes the expansion of expandable section 403, providing a larger, more effective, more buoyant device to the user and the person or object being rescued. In some such embodiments, the user first directs expandable section 403 toward, or positions expandable section 403 below, an area below and underneath at least part of the person or object being rescued. In some such embodiments, expandable section 403 then expands and fills space below the person or object being rescued and, as it rises due to increased buoyancy, below the person or object being rescued, expandable section 403 lifts the person or object being rescued upwards, until the person or object is at least partially above the surface of a body of water.

Figure 9:
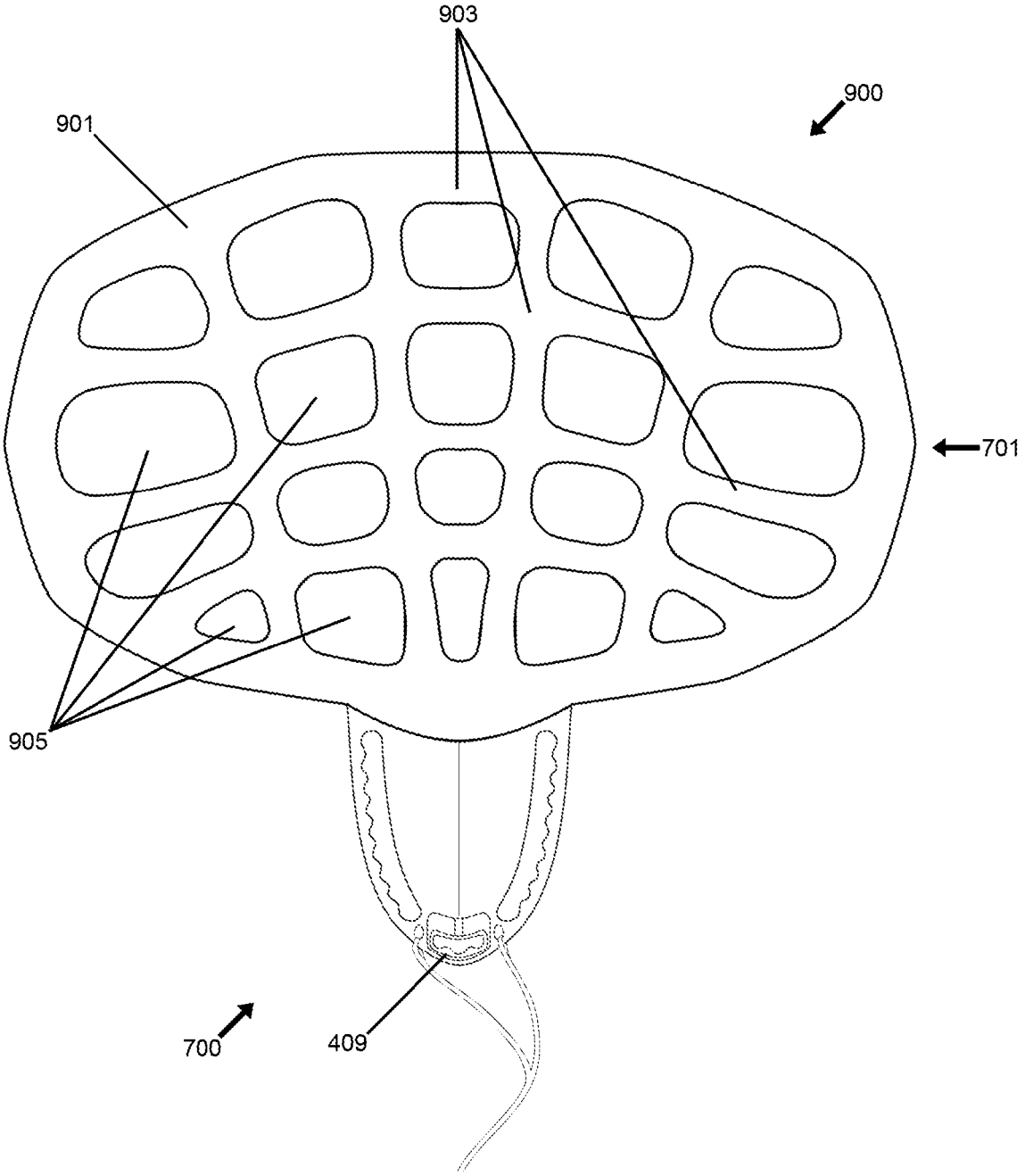
FIG. 9 is a top view of the same example rescue device discussed immediately above, in a state of full expansion, in accordance with some embodiments of the present invention.
Figure 10:
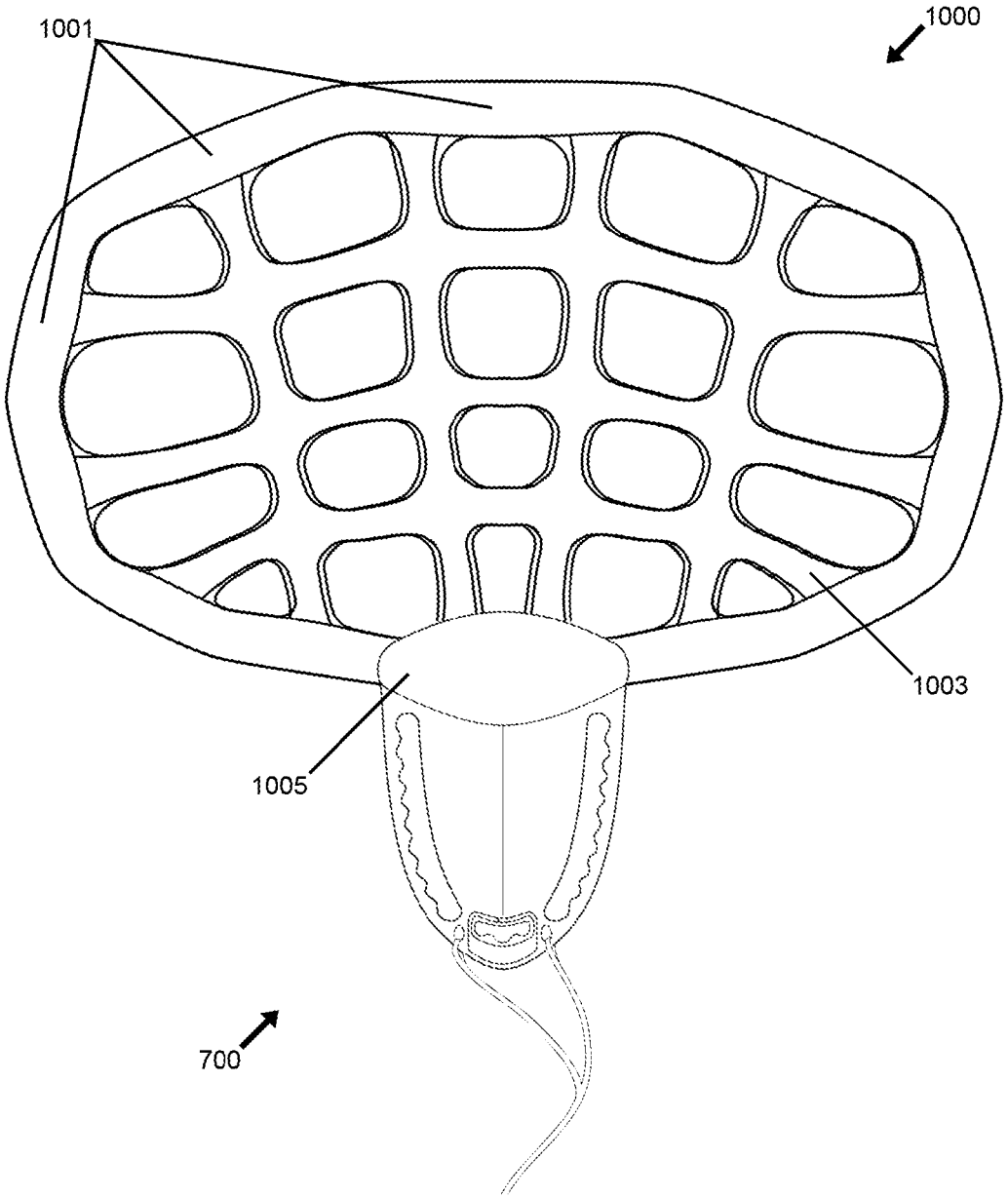
FIG. 10 is a top view of the same example rescue device discussed immediately above, in another embodiment of a state of full expansion, in accordance with some aspects of the present invention.

To cause the expansion of expandable section 403, a user may inflate expandable section 403 by introducing a gas into it. As with other rescue devices set forth above, in some embodiments, expandable section 403 comprises flexible, expandable tubes, as shown in FIGS. 9 and 10, below, which fill with air or another gas, expanding section 403, and increasing its size and buoyancy. In some embodiments, expandable section 403 is expanded by structural springs. For example, in some such embodiments, such structural springs include an elastic foam. As another example, in some such embodiments, such structural springs include elastic ribs within expandable section 403. In any event, regardless of the mechanism used in a particular embodiment to expand expandable section 403, expandable section 403 is expanded by a user control in some embodiments. For example, in some such embodiments, hand control 409 is provided which, when actuated (e.g., pulled) by a user (i.e. activated) causes the initiation of that mechanism of expansion. In some such embodiments, such a control is a mechanical control, opening a valve or otherwise triggering a physical event that expands expandable section 403. In some embodiments, hand control 409 may be a switch (such as an electronic switch) connected to a control system which commands an actuator to cause the expansion of expandable section 403. Examples of each of such embodiments will be discussed in greater detail below.

As mentioned above, in some embodiments, in addition to expanding to become larger, expandable section 403 may exhibit a different shape upon expanding, such as a bar or a ring. In some such embodiments, parts of expandable section 403 may turn in space to create such different expanded forms. To aid in such turning, in some embodiments, folded sections of expandable section 403, as shown by example folds 413, may be provided. Such folds may unfold, and expose such different shapes upon such unfolding, in some embodiments.

In some embodiments, rescue device 400 may be buoyant in a body of water, even when expandable section 403 is in an unexpanded state, as pictured. Thus, in such embodiments, rescue device 400 serves as a swimming aid and rescue tool even prior to expansion of expandable section 403 (albeit, not one of as great buoyancy, and not as effective at lifting a person or object).

In some embodiments, to aid in retrieving rescue device 400, and, in some embodiments, to allow rescue device 400 to trail behind a user while swimming, a leash 415 may be provided. In some such embodiments, such a leash may be threaded through port holes within main body 405, such as example port holes 417, and tied or otherwise fastened to them. In some embodiments, leash 415 may be wrapped about a narrow section 419 of rescue device 400 for easy stowing, when not in use.

Figure 5:
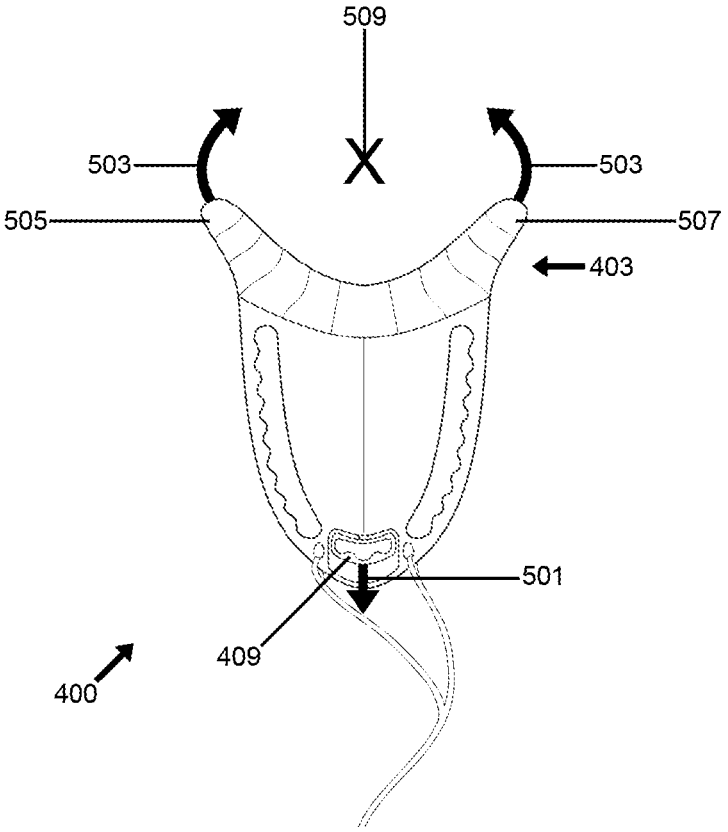
FIG. 5 is a top view of the same example rescue device set forth above, in reference to FIG. 4, with a state of activation illustrated, in accordance with some embodiments of the present invention.

FIG. 5 is a top view of the same example rescue device 400, in a state of activation, in accordance with some embodiments of the present invention. As mentioned above, in some such embodiments, hand control 409 is provided which, when actuated (e.g., pulled) by a user (i.e. activated) causes the initiation of a mechanism of expansion of expandable section 403. To illustrate an example direction of actuation of example hand control 409, motion- or force-indicating vector arrow 501 is provided, which shows that hand control 409 is pulled downward to actuate it, and cause the expansion of expandable section 403. The initial movements of expandable section 403, which occur after the start of such expansion, are further illustrated by motion- or force-indicating vector arrows 503.

Also as mentioned above, in some embodiments, in addition to expanding to become larger, expandable section 403 may exhibit a different shape upon expanding, such as a bar or a ring, and parts of expandable section 403 may turn in space to create such different expanded forms, in some embodiments. To illustrate one example of such expansions, leading to such shapes, vector arrows 503 show that two leading ends, 505 and 507, of expandable section 403 will lengthen but also turn inward toward one another, and can thus be made to encircle a person or other object located in a target area 509, indicated by the X symbol, shown in the figure. That expansion and resulting shape will be explained in greater detail, below. In some embodiments, a user may press expandable section 403 into a person or other object being rescued, prior to causing such expansion of expandable section 403, ensuring that the person or other object is within target area 509, and will be encircled, held and lifted by that expansion and increased buoyancy of expandable section 403. In some such embodiments, a user may press the middle of a recovered-person-facing side 511 of expandable section 403 into a mid-section of a recovered person's body (e.g., his or her waist or chest) ensuring that the person or other object is within target area 509, and will be encircled, held and lifted by that expansion and increased buoyancy of expandable section 403.

Figure 6:
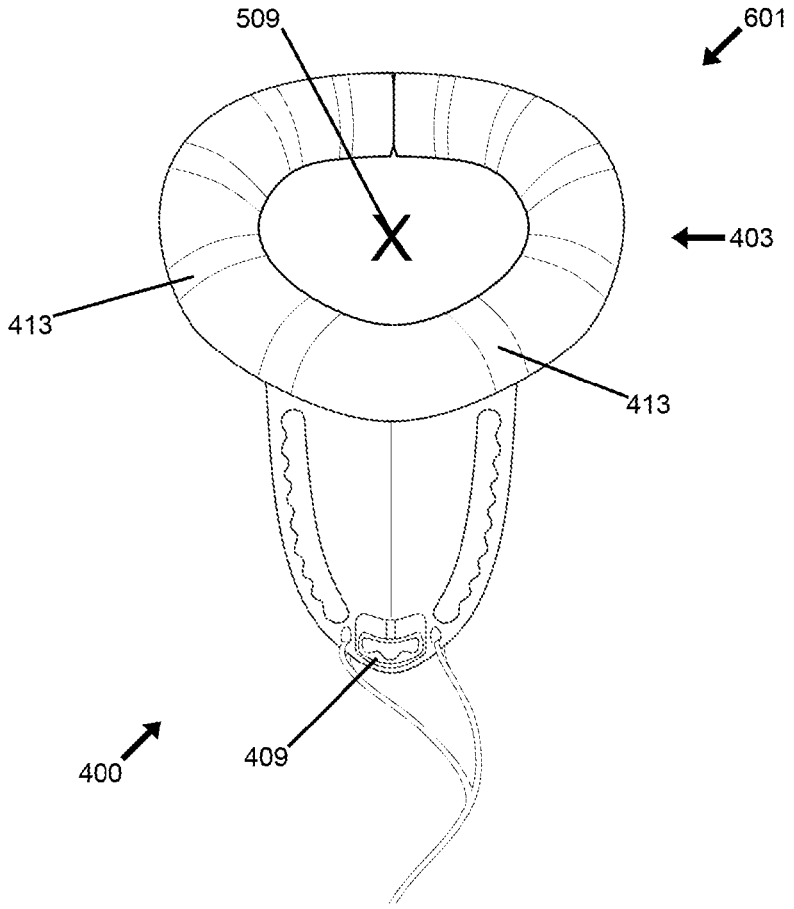
FIG. 6 is a top view of the same example rescue device set forth above, in reference to FIGS. 4 and 5, in a state of full expansion, in accordance with some embodiments of the present invention.

FIG. 6 is a top view of the same example rescue device 400, in a state of full expansion 601, in accordance with some embodiments of the present invention. As discussed above, in reference to FIG. 5, hand control 409 has now been fully actuated, and is now in a position shifted fully downward. As also discussed above, that actuation has caused the expansion of expandable section 403, which has now formed a ring fully encircling target area 509, and any person or object located within target area 509.

It should be noted that example folds 413 are now shown unfolded, exposing underlying outer surface that partly drove the directional expansion, and resulting ring shape, of expanded expandable section 403.

Figure 7:
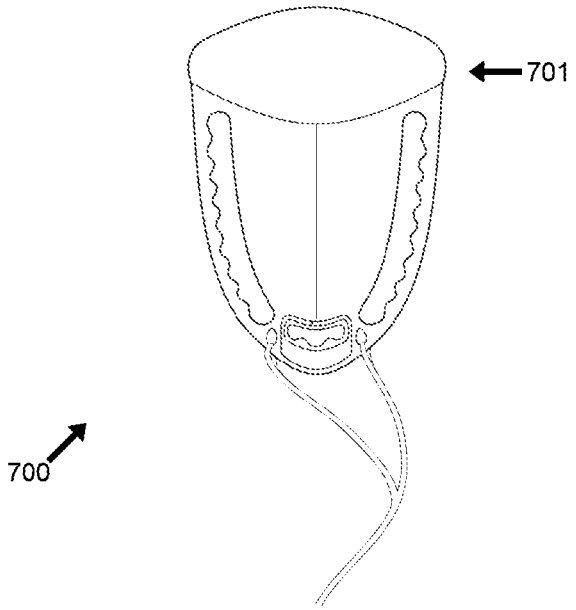
FIG. 7 is a top view of another example rescue device, in accordance with some embodiments of the present invention, with a more streamlined expandable section.

FIG. 7 is a top view of another example rescue device 700, in accordance with some embodiments of the present invention, with a more streamlined expandable section 701. This alternate format for expandable device sections, as set forth in this application, may allow for easier swimming by a user of rescue device 700 when compared to other formats set forth in the present application. In some embodiments, such an alternate format also aids in the formation of different expanded shapes and types of expandable device sections, optimized for different purposes.

Such an alternative shape and type of expandable device section will be discussed in greater detail below.

Figure 8:
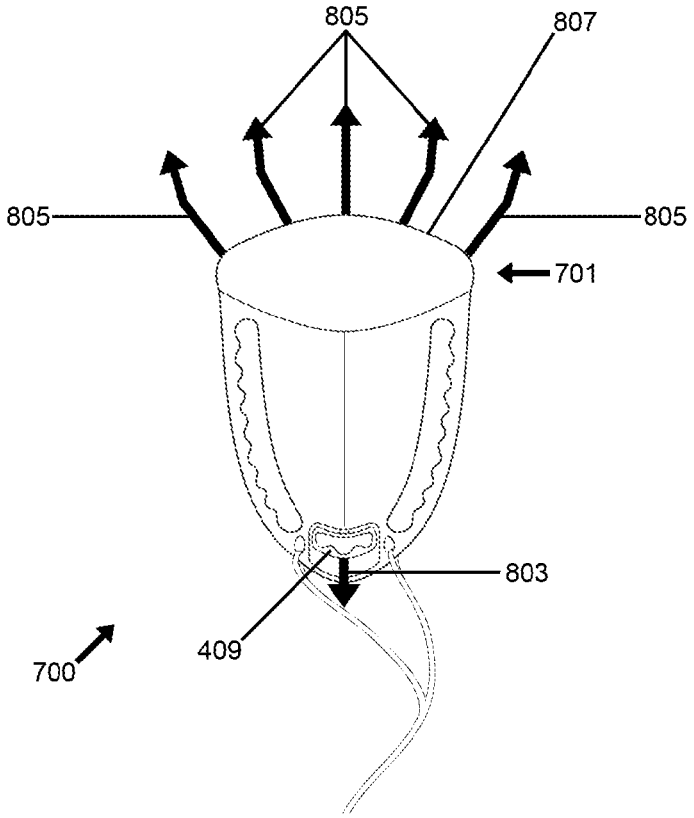
FIG. 8 is a top view of the same example rescue device discussed immediately above, in a state of activation, in accordance with some embodiments of the present invention.

FIG. 8 is a top view of the same example rescue device 700, discussed immediately above, in a state of activation, in accordance with some embodiments of the present invention.

As mentioned above, in some such embodiments, hand control 409 is provided which, when actuated (e.g., pulled) by a user (i.e. activated) causes the initiation of a mechanism of expansion of an expandable section of a rescue device, such as expandable section 701. To illustrate an example direction of actuation of example hand control 409, motion- or force-indicating vector arrow 803 is provided, which shows that hand control 409 is pulled downward to actuate it, and cause the expansion of expandable section 701. The initial movements of expandable section 701, which occur after such actuation the start of such expansion, are further illustrated by motion- or force-indicating vector arrows 805.

Also as mentioned above, in some embodiments, in addition to expanding to become larger, expandable sections such as example expandable section 701 may exhibit a different shape upon expanding, such as a buoyant net. In some embodiments, parts of expandable section 701 may turn in space to create such different expanded forms, in some embodiments. To illustrate one example of such expansions, leading to such shapes, vector arrows 805 show that curved leading edge 807 of expandable section 701 will first extend outward laterally, as expandable section 701 expands, but will then turn away from the remainder of rescue device 700, and extend away from the remainder of rescue device 700, creating a complex platform as expandable section 701 expands.

A resulting structure and shape for expanded expandable section 701 will be discussed in greater detail below.

FIG. 9 is a top view of the same example rescue device 700 discussed above, in a state of full expansion 900, in accordance with some embodiments of the present invention.

As discussed above, in reference to FIG. 6, hand control 409 has now been fully actuated, and is now in a position shifted fully downward. As also discussed above, that actuation has caused the expansion of expandable section 701, which has now formed a complex expanded, buoyant form, in the shape of an expanded net 901. As with other expanded, buoyant nets set forth in the present application, expanded net 901 may be formed by a series of interconnected tubes, such as example interconnected tubes 903, which include expanded internal volumes in some embodiments. Those expanded internal volumes may be expanded by any technique for physical expanding devices known in the art that decrease the density of objects. For example, as discussed above, in some embodiments, interconnected tubes 903 may be inflated with air or another gas, example mechanisms for which will be discussed in greater detail below.

As with other expanded floating nets set forth in this application, expanded net 901 may form and/or comprise a matrix of holes, such as the example holes 905, in some embodiments, which allow water to pass through expanded net 901 as it rises through water, capturing and raising a person or other object above it, and raising the person or object at least partially above a surface of a body of water, in some embodiments.

FIG. 10 is a top view of the same example rescue device 700 discussed above, in accordance with some embodiments of the present invention, with another embodiment of a state of full expansion 1000 illustrated. Although in a state very similar to that set forth above in reference to FIG. 9, state of full expansion 1000 also includes an outer inflated lip 1001, partially separated from and raised up the remainder of an expanded net 1003. In addition, a lip gripping housing piece 1005 is shown, which retains part of the original shape of rescue device 700, prior to inflation, and protects a connection with (e.g., by remaining fastened to) expanded net 1003.

Figure 11:
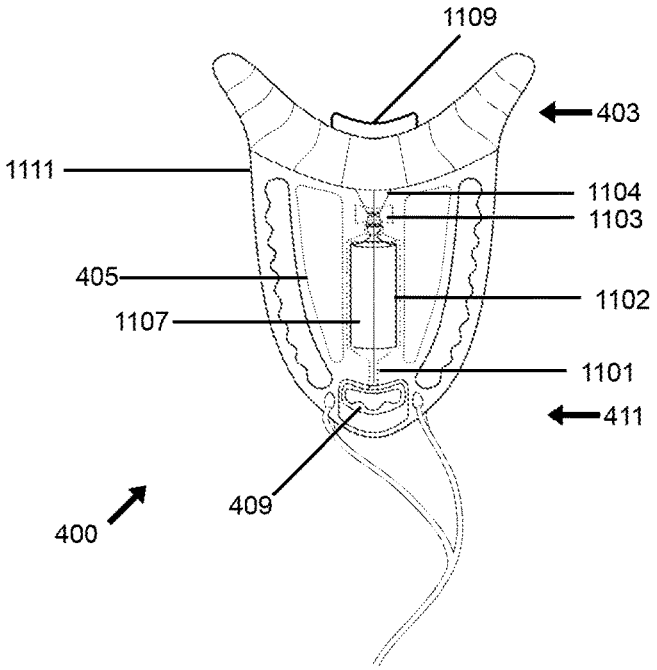
FIG. 11 is a top view of the same example rescue device shown in FIGS. 4-6, above, but revealing an example mechanism for a user to cause the expansion of expandable section, in accordance with some aspects of the present invention.

FIG. 11 is a top view of the same example rescue device 400 shown in FIGS. 4-6, above, but revealing an example mechanism for a user to cause the expansion of expandable section 403. As discussed above, hand control 409 is provided which, when actuated (e.g., pulled) by a user (i.e. activated) causes the initiation of that mechanism of expansion. In some such embodiments, such a control is a mechanical control, opening a valve or otherwise triggering a physical event that expands expandable section 403. Thus, hand control 409 is pictured attached to a connecting rod 1101, which is slidingly mounted on main body 405. As a user actuates hand control 409, pulling it towards user-facing end 411, a compressed gas-containing compartment 1102 is pulled away from a valve section 1103, connected to it. As a result, a seal is opened, allowing the escape of compressed gas into distribution tubes, such as exemplary conduit tube 1104, which feed into an interior space of expandable section 403, inflating and expanding it.

In some embodiments, hand control 409 may be a switch (such as an electronic switch) connected to a control system, such as example control system 1250, shown in embodiments described in reference to FIG. 12, discussed below, which commands an actuator (e.g., of valve section 1103) to cause the inflation and expansion of expandable section 403. In some embodiments, a replaceable canister of compressed gas 1107 may be introduced into compressed gas-containing compartment 1102, to replenish rescue device 400's stock of compressed gas after use.

In some embodiments, a safety device may also be included in any rescue device set forth in this application, which safety device does not allow the expansion of an expandable section, even if another control configured to cause such expansion has been actuated, unless the safety device is subjected to a physical contact, deactivating the safety device. For example, in some embodiments, a moving piece 1109 is provided, outside a wall or housing 1111 of rescue device 400.

Figure 12:
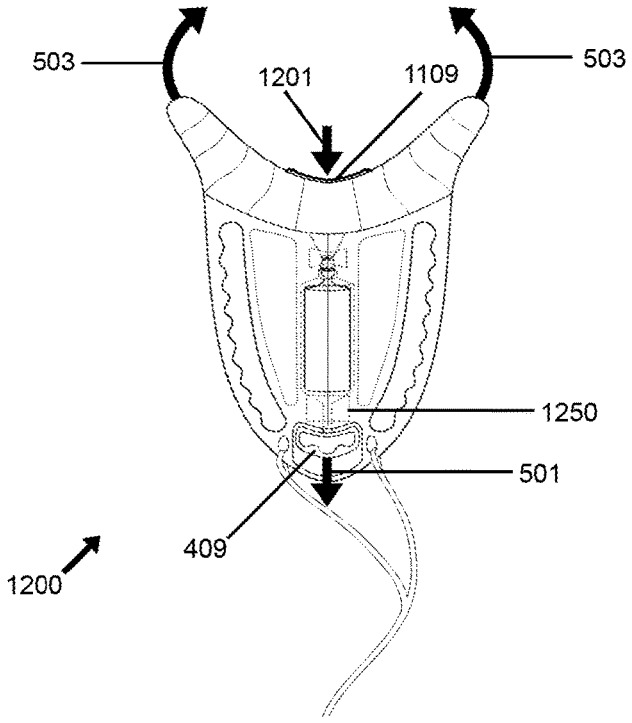
FIG. 12 is a top view of the same example rescue device shown in FIG. 11, above, in a state of activation, and illustrating the function of a safety mechanism of the rescue device.

As shown in FIG. 12, in some embodiments, moving piece 1109 moves inward (as shown by motion- or force-indicating vector arrow 1201), toward the remainder of rescue device 400, when subjected to physical contact, and deactivates the safety device. Assuming that a user has also actuated hand control 409 (e.g., by pulling it) (i.e. activated), the expansion of expandable section 403 is initiated, as again illustrated by motion- or force-indicating vector arrows 503. To illustrate an example direction of actuation of example hand control 409, motion- or force-indicating vector arrow 501 is also, again, provided, which shows that hand control 409 is pulled downward to actuate it, and, along with deactivating the safety by so moving it inward, causes the expansion of expandable section 403. Thus, in some embodiments, actuating hand control 409, alone, is insufficient to cause the expansion of expandable section 403. Similarly, in some embodiments, actuating the safety by contacting moving piece 1109, alone, is insufficient to cause the expansion of expandable section 403. In some embodiments, a temporal ordering of actuating hand control 409 and the safety mechanism is a prerequisite to causing the expansion of expandable section 403. For example, in some such embodiments, moving piece 1109 must be contacted first, before actuating hand control 409, or the control device must be reset (e.g., by releasing moving piece 1109) before the expansion of expandable section 403 via another attempted expansion of expandable section 403, as discussed above. As another example, in some embodiments, hand control 409 must be actuated first, before contacting moving piece 1109, or the control device must be reset (e.g., by releasing hand control 409) before the expansion of expandable section 403 via another attempted expansion of expandable section 403, as discussed above.

Figure 13:
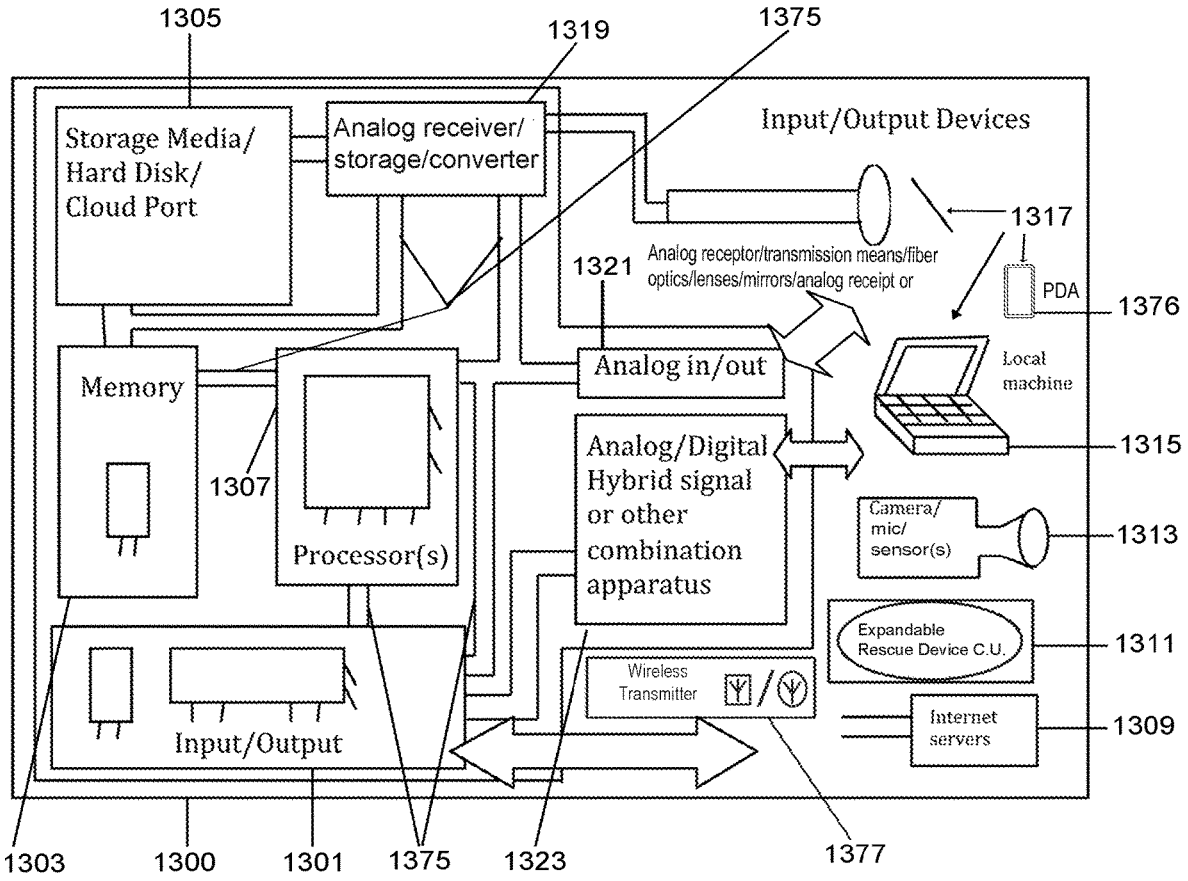
FIG. 13 is a schematic block diagram of some elements of an exemplary control system that may be used in accordance with aspects of the present invention.

FIG. 13 is a schematic block diagram of some elements of an exemplary control system 1300 that may be used in accordance with aspects of the present invention, such as, but not limited to, managing and carrying out the inflation or other expansion of inflatable bodies of a rescue tool or device, with or without user controls. The generic and other components and aspects described herein are not exhaustive of the many different systems and variations, including a number of possible hardware aspects and machine-readable media that might be used, in accordance with the present invention. Rather, the system 1300 is described to make clear how aspects may be implemented. Among other components, the system 1300 includes an input/output device 1301, a memory device 1303, storage media and/or hard disk recorder and/or cloud storage port or connection device 1305, and a processor or processors 1307. The processor(s) 1307 is (are) capable of receiving, interpreting, processing and manipulating signals and executing instructions for further processing and for output, pre-output or storage in and outside of the system. The processor(s) 1307 may be general or multipurpose, single- or multi-threaded, and may have a single core or several processor cores, including, but not limited to, microprocessors. Among other things, the processor(s) 1307 is/are capable of processing signals and instructions for the input/output device 1301, analog receiver/storage/converter device 1319, analog in/out device 1321, and/or analog/digital or other combination apparatus 1323 to cause a display, light-affecting apparatus and/or other user interface with active physical controls, such as buttons, switches, actuable hand grips and displays, and control actuation and other monitoring hardware, any of which may be comprised or partially comprised in a GUI, to be provided for use by a user on hardware, such as a specialized personal computer monitor, remote control device or PDA (Personal Digital Assistant) or control unit screen (including, but not limited to, monitors or touch- and gesture-actuable displays) or a terminal monitor with a mouse and keyboard or other input hardware and presentation and input software (as in a software application GUI), and/or other physical controls, such as buttons, sliders, knobs, actuable hand grips, LEDs or LCDs. Alternatively, or in addition, the system, using processors 1307 and input/output devices 1319, 1321 and/or 1323, may accept and exert passive and other physical (e.g., tactile) user, power supply, appliance operation, user activity, circuit and environmental input (e.g., from sensors) and output.

For example, and in connection with aspects of the invention discussed in reference to other figures set forth in the present application, the system may carry out any aspects of the present invention as necessary with associated hardware and/or using specialized software, including, but not limited to, controlling actuators and safety mechanisms for causing the inflation or other expansion of expandable bodies of a rescue tool or device. The system may also, among many other things described for control systems in this application, respond to user, sensor and other input (for example, by a user-actuated GUI controlled by computer hardware and software or by another physical control) to issue alerts, alter settings, control alarms and alerts associated with operative conditions, authenticate users or remote control devices and give and receive instructions and commands to other devices and users, or perform any other aspect of the invention requiring or benefiting from use of a control system. The system 1301 may permit the user and/or system-variation of settings, including but not limited to the effects of user activity on modes of operation of the system, and send external alerts and other communications (for example, to users or other administrators) via external communication devices, for any control system, remote control or other control unit aspect that may require or benefit from such external or system-extending communications.

The processor(s) 1307 is/are capable of processing instructions stored in memory devices 1303 and/or 1305 (and/or ROM or RAM), and may communicate with any of these, and/or any other connected component, via system buses 1375. Input/output device 1301 is capable of input/output operations for the system, and may include/communicate with any number of input and/or output hardware, such as a computer mouse, keyboard, entry pad, actuable display, networked or connected second computer or processing device, control unit, other GUI aspects, camera(s) or scanner(s), sensor(s), microphone(s), sensor/motor(s), actuable electronic components (with actuation instruction receiving and following hardware), RF antennas, other radiation, wave or electrical characteristics reading, monitoring, storage and transmission affecting hardware, as discussed in this application, range-finders, GPS systems, receiver(s), transmitter(s), transceiver(s), transflecting transceivers ("transflecters" or "transponders"), antennas, electromagnetic actuator(s), mixing board, reel-to-reel tape recorder, external hard disk recorder (solid state or rotary), additional hardware controls (such as, but not limited to, buttons and switches, and actuators, current or potential applying contacts and other transfer elements, light sources, speakers, additional video and/or sound editing system or gear, filters, computer display screen or touch screen. It is to be understood that the input and output of the system may be in any useable form, including, but not limited to, signals, data, commands/instructions and output for presentation and manipulation by a user in a graphical user interface "GUI". Such a GUI hardware unit and other input/output devices could, among other things, implement a user interface created by non-transitory machine-readable means, such as software, permitting the user to carry out any of the user settings, commands and input/output discussed above, and elsewhere in this application.

1301, 1303, 1305, 1307, 1319, 1321 and 1323 are connected and able to communicate communications, transmissions and instructions via system busses 1375. Storage media and/or hard disk recorder and/or cloud storage port or connection device 1305 is capable of providing mass storage for the system, and may be a computer-readable medium, may be a connected mass storage device (e.g., flash drive or other drive connected to a U.S.B. port or Wi-Fi) may use back-end (with or without middle-ware) or cloud storage over a network (e.g., the internet) as either a memory backup for an internal mass storage device or as a primary memory storage means, and/or may be an internal mass storage device, such as a computer hard drive or optical drive.

Generally speaking, the system may be implemented as a client/server arrangement, where features of the invention are performed on a remote server, networked to the client and facilitated by software on both the client computer and server computer. Input and output devices may deliver their input and receive output by any known means of communicating and/or transmitting communications, signals, commands and/or data input/output, including, but not limited to, input through the devices illustrated in examples shown as 1317, such as 1309, 1311, 1313, 1315, 1376 and 1377 and any other devices, hardware or other input/output generating and receiving aspects—e.g., a PDA networked to control a control unit 1377 with the aid of specialized software (a.k.a. a "PDA Application" or "App.") Any phenomenon that may be sensed may be managed, manipulated and distributed and may be taken or converted as input or output through any sensor or carrier known in the art. In addition, directly carried elements (for example a light stream taken by fiber optics from a view of a scene) may be directly managed, manipulated and distributed in whole or in part to enhance output, and radiation or whole ambient light or other radio frequency ("RF") information for an environmental region may be taken by a photovoltaic apparatus for battery cell recharging if battery power is included as the power source for the control system, or sensor(s) dedicated to angles of detection, or an omnidirectional sensor or series of sensors which record direction as well as the presence of electromagnetic or other radiation. While this example is illustrative, it is understood that any form of electromagnetism, compression wave or other sensory phenomenon may become such an "ambient power" source harnessed to power the operations of a control unit and/or control system and/or may include such sensory directional and 3D locational or other operations-identifying information, which may also be made possible by multiple locations of sensing, preferably, in a similar, if not identical, timeframe. The system may condition, select all or part of, alter and/or generate composites from all or part of such direct or analog image or other sensory transmissions, including physical samples (such as DNA, fingerprints, iris, and other biometric samples or scans) and may combine them with other forms of data, such as image files, dossiers, appliance-identifying files, or operations-relevant recordings, or metadata, if such direct or data encoded sources are used. In addition to keys, codes entered into a GUI, fob, remote control or beacon signals, authentication aspects of the present invention may also or alternatively be carried out with biometric challenge and detection hardware, such as fingerprint, iris, DNA or other pattern scans While the illustrated system example 1300 may be helpful to understand the implementation of aspects of the invention, it should be understood that any form of computer system may be used to implement many control system and other aspects of the invention—for example, a simpler computer system containing just a processor (datapath and control) for executing instructions from a memory or transmission source. The aspects or features set forth may be implemented with, as alternatives, and/or in any combination, digital electronic circuitry, hardware, software, firmware, or in analog or direct (such as electromagnetic wave-based, physical wave-based or analog electronic, magnetic or direct transmission, without translation and the attendant degradation, of the medium) systems or circuitry or associational storage and transmission, any of which may be aided with enhancing media from external hardware and software, optionally, by wired or wireless networked connection, such as by LAN, WAN or the many connections forming the internet or local networks. The system can be embodied in a tangibly-stored computer program, as by a machine-readable medium and propagated signal, for execution by a programmable processor. The method steps of the embodiments of the present invention also may be performed by such a programmable processor, executing a program of instructions, operating on input and output, and generating output. A computer program includes instructions for a computer to carry out a particular activity to bring about a particular result, and may be written in any programming language, including compiled and uncompiled, interpreted languages, assembly languages and machine language, and can be deployed in any form, including a complete program, module, component, subroutine, or other suitable routine for a computer program.

I claim:

1. A device for rescuing persons or objects immersed in water, comprising:

a net of at least one inflatable body(ies), configured to be inflated by a user;

at least one handle or grip, connected with the net of at least one inflatable body(ies).

2. The device for rescuing of claim 1, wherein said net of at least one inflatable body(ies) are tubes comprising air- or other gas-tight flexible walls.

3. The device for rescuing of claim 1, wherein said at least one inflatable body(ies) comprise an elastic material in a compressed state that, when the elastic material in a compressed state is released, causes the expansion of said net.

4. The device for rescuing of claim 1, wherein said device comprises a switch or other user-operated control; and wherein said switch or other user-operated control is configured to inflate at least some of said at least one inflatable body(ies).

5. The device for rescuing of claim 4, wherein said switch or other user-operated control is located within or adjacent to said handle or grip.

6. A device for rescuing persons or objects immersed in water, comprising:

at least one expandable body(ies), in an unexpanded state and configured to be expanded by a user;

a handle or grip connected with a net of expandable body(ies);

wherein said device comprises a switch or other user-operated control configured to expand said expandable bodies.

7. The device for rescuing of claim 6, wherein said at least one expandable body(ies) comprise a gas when expanded.

8. The device for rescuing of claim 6, wherein said at least one expandable body(ies) comprise an elastic material in a compressed state that, when the elastic material in a compressed state is released, causes the expansion of said net.

9. The device for rescuing of claim 6, wherein said device comprises a safety device that, when in an active state, is configured to prevent operation of said user-operated control and wherein said user-operated control is configured to expand said expandable bodies only when said safety device is in an inactive state.

10. The device for rescuing of claim 9, wherein said safety device comprises a moving piece at least partially exposed from a housing of said device.

11. The device for rescuing of claim 9, wherein said safety device is deactivated by said moving piece contacting a person or other object.

12. The device for rescuing of claim 11, wherein said moving piece is located on one side of said device.

13. The device for rescuing of claim 6, wherein at least some of said at least one expandable body(ies) turn during expansion to form an encircling configuration for enveloping one of said person(s) or other object(s) after expanding.

14. The device for rescuing of claim 13, comprising at least one fastener configured to link one end of at least one of said at least one expandable body(ies) with another end of at least one of said at least one expandable body(ies) and to retain said encircling configuration for enveloping one of said person(s) or other object(s).

15. The device for rescuing of claim 6, comprising a rescue buoy or other buoyant body.

16. The device for rescuing of claim 12, wherein said at least one expandable body(ies) are configured to expand by stretching.

17. A method for rescuing a person or object from a body of water, comprising the following steps:

obtaining a device for rescuing persons or objects immersed in water, comprising:

at least one expandable body(ies), in an unexpanded state and configured to be expanded by a user;

a handle or grip connected with a net of expandable bodies;

wherein said device comprises a switch or other user-operated control configured to expand said expandable bodies.

18. The method of claim 16, comprising the following additional step:

activating said switch or other user-operated control of said device, causing said being expanded of said at least one expandable body(ies).

19. The method of claim 17, comprising the following additional step:

positioning said expandable body(ies) at least partially under a person or object prior to said causing said being expanded of said at least one expandable body(ies).

20. The method of claim 16, wherein said switch or other user-operated control is located adjacent to said handle or grip.

* * * * *